US006647939B2

(12) United States Patent
Manabe et al.

(10) Patent No.: US 6,647,939 B2
(45) Date of Patent: Nov. 18, 2003

(54) VEHICLE ENGINE STARTING SYSTEM AND METHOD

(75) Inventors: Kouji Manabe, Hadano (JP); Kazuhira Kobayashi, Ebina (JP)

(73) Assignee: Nissan Motor Co., Ltd., Kanagawa (JP)

( * ) Notice: Subject to any disclaimer, the term of this patent is extended or adjusted under 35 U.S.C. 154(b) by 51 days.

(21) Appl. No.: 09/993,677

(22) Filed: Nov. 27, 2001

(65) Prior Publication Data

US 2002/0078914 A1 Jun. 27, 2002

(30) Foreign Application Priority Data

Dec. 25, 2000 (JP) ..... 2000-392152

(51) Int. Cl.[7] ..... F02N 17/00
(52) U.S. Cl. ..... 123/179.3; 320/135
(58) Field of Search ..... 123/179.3, 179.4; 307/10.6, 48, 50, 64, 66; 290/38 R, 38 C; 320/104, 135, 136

(56) References Cited

U.S. PATENT DOCUMENTS 5,596,956 A * 1/1997 Ogawa et al. ..... 123/90.11
5,967,106 A * 10/1999 Schulze et al. ..... 123/179.3
6,321,707 B1 * 11/2001 Dunn ..... 123/179.3

FOREIGN PATENT DOCUMENTS

JP 10-285813 10/1998

* cited by examiner

*Primary Examiner*—Tony M. Argenbright
*Assistant Examiner*—Arnold Castro
(74) *Attorney, Agent, or Firm*—McDermott, Will & Emery

(57) ABSTRACT

A vehicle engine starting system that drives a starter motor engaged to start an engine by using a lithium secondary battery as a power source comprises a voltage sensor that detects a voltage at the secondary battery and a control device that allows power to be discharged from the secondary battery to the starter motor if the voltage at the secondary battery detected by the voltage sensor is equal to or higher than a predetermined value and disallows a discharge from the secondary battery to the starter motor if the voltage at the secondary battery detected by the voltage sensor is lower than the predetermined value.

10 Claims, 7 Drawing Sheets

VEHICLE ENGINE STARTING SYSTEM AND METHOD

BACKGROUND OF THE INVENTION

1. Field of the Invention

The present invention relates to a method of, and a system for starting an engine in a vehicle mounted with a secondary battery.

2. Description of the Related Art

A vehicle today may be mounted with a lithium secondary battery which is constituted as a battery pack achieved by, for instance, connecting in series a plurality of lithium ion cells. If a drive source of this vehicle is an internal combustion engine, the lithium secondary battery is utilized as the power source when driving the starter motor to start the engine.

The output performance (discharge characteristics) of a battery is greatly affected by the temperature under normal circumstances. It is difficult to achieve a sufficient output power level with a lithium secondary battery at a low temperature of, for instance, −30° C. In such a case, the torque and the rotation rate required at the starter motor cannot be assured and thus, the engine cannot be started.

Japanese Laid-Open Patent Publication No. H 10-285813 discloses a technology through which the required power level is obtained by heating the lithium secondary battery when the temperature is low.

FIG. 6 shows a schematic structure that may be assumed when this prior art technology is adopted in an engine starting system. A starter motor 30 is connected to a lithium secondary battery 1 via a starter relay 6 connected to a key switch 2. This engine starting system includes the lithium secondary battery 1, a heater 32 that heats the secondary battery 1 from the outside, a temperature sensor 34 that detects the temperature in the vicinity of the secondary battery 1, a voltage sensor 9 that detects the terminal voltage at the secondary battery 1 and a battery controller 36 that controls the overall operation. The battery controller 36 is supplied with power from the secondary battery 1 via an ignition relay 3. The heater 32 is controlled via a heater switch 33.

If the terminal voltage at the lithium secondary battery 1 is equal to or lower than a specific voltage level and the temperature in the vicinity of the secondary battery 1 is low when the key switch is turned on and the starter motor drive starts, the battery controller 36 engages the heater 32 in operation to heat the vicinity of the secondary battery 1. Once temperature of the secondary battery 1 reaches a level at which appropriate discharge characteristics are achieved and the terminal voltage at the secondary battery 1 exceeds the predetermined voltage level, the battery controller 36 implements control on the starter relay 6 so as to supply the power from the lithium secondary battery 1 to the starter motor 30.

SUMMARY OF THE INVENTION

However, the engine starting system adopting the prior art technology described above requires the heater 32 for heating the lithium secondary battery 1 from the outside and the temperature sensor 34 for detecting the temperature in the vicinity of the secondary battery 1 in addition to the voltage sensor 9, and thus, the number of required parts increases. In addition, since the battery controller 36 must engage in complex control processing during which the heater 32 is engaged in operation depending upon the terminal voltage at the secondary battery 1 and the temperature in the vicinity of the secondary battery 1 and then the starter relay 6 is controlled based upon the terminal voltage at the secondary battery 1, the cost of the system is bound to be high. Furthermore, since numerous sensors must be utilized to start the engine, the reliability of engine start cannot be assured easily. For instance, if a failure occurs at the temperature sensor 34, the engine start control is disabled.

It is possible to reduce the production costs by not providing the voltage sensor 9. Namely, the lithium secondary battery 1 may be heated from the outside by the heater 32 and it may be judged as to whether or not power can be supplied based upon the temperature in the vicinity of the secondary battery 1. However, since the secondary battery 1 is heated from the outside in this method, there is bound to be a difference between the surface temperature of the secondary battery 1 detected by the temperature sensor 34 and the temperature inside the battery 1. Thus, a problem arises in that very different output characteristics may manifest even when the temperature in the vicinity of the secondary battery 1 detected by the temperature sensor 34 remains unchanged. The difference between the surface temperature and the internal temperature becomes more pronounced when the temperature of the secondary battery 1 is low.

This problem is now discussed in further detail in reference to FIG. 7. Voltage characteristics D indicate the change in the terminal voltage that occurs over time after the heater 32 starts to heat the secondary battery 1. Temperature characteristics H1 indicate the change in the temperature near the secondary battery 1 and temperature characteristics H2 indicate the change in the internal temperature of the secondary battery 1. The discharge characteristics that allow the engine to be started by the starter motor 30 are achieved at the temperature δ. Namely, the engine cannot be started at the temperature lower than the temperature δ.

When the control described above is implemented, the heater 32 first heats the vicinity of the secondary battery 1 if the temperature of the secondary battery 1 is low. Subsequently, power is supplied to the starter motor 30 after the temperature (H1) detected in the vicinity of the secondary battery 1 reaches the temperature δ (point P1). However, since the internal temperature (H2) of the secondary battery is lower than the temperature δ in reality, the heater 32 must be further driven over a considerable length of time. Since the power from the secondary battery 1 is utilized to drive the heater 32, the terminal voltage (D) continues to decrease. As a result, the terminal voltage is lowered to a lowest allowable voltage C (point P2) without achieving a sufficient output for starting the engine, and thus, the engine cannot be started. Under these circumstances, internal shorting may occur in the secondary battery itself to reduce the service life, as well.

It is also possible that a reference value indicating the temperature level at which it is judged that power can be supplied to the starter motor 30 may be set higher than the temperature δ by taking into consideration the difference between the surface temperature and the internal temperature at the secondary battery 1. However, this method poses a problem in that as the heater 32 is supplied with more power than it requires from the secondary battery 1, the available power in the secondary battery 1 is wasted.

An object of the present invention is to provide a vehicle engine starting method and a vehicle engine starting system that make it possible to start an engine with a high degree of efficiency at a low temperature, prevent wasteful power consumption and achieve a high degree of reliability.

In a vehicle engine starting method for driving a starter motor by using a secondary battery as a power source, a voltage at the secondary battery is detected, the detected voltage at the secondary battery is compared with a predetermined value and a power discharge from the secondary battery to the starter motor is allowed if the detected voltage of the secondary battery is equal to or higher than the predetermined value and a discharge is disallowed from the secondary battery to the starter motor if the detected voltage is lower than the predetermined value.

A vehicle engine starting method for supplying power in a secondary battery to a starter motor provided to start an engine via a key switch and a starter relay comprises an engine start procedure during which a voltage at the secondary battery is detected, the detected voltage at the secondary battery is compared with a predetermined value, the starter relay is set in advance in an on-enabled state if the detected voltage at the secondary battery is equal to or higher than the predetermined value whereas the starter relay is set in advance in an on-disabled state if the detected voltage is lower than the predetermined value and the starter relay is turned on to discharge power from the secondary battery to the starter motor as the key switch is set to a start position while the starter relay is in the on-enabled state, and the engine start procedure is repeated until the engine is started.

A vehicle engine starting method for supplying power in a secondary battery to a starter motor utilized to start an engine via a key switch and a starter relay comprises an engine start procedure during which a detection is made to determine whether or not the key switch is set at a start position, a voltage at the secondary battery is detected once the key switch is set to the start position, the detected voltage at the secondary battery is compared with a predetermined value and the starter relay is turned on to discharge power from the secondary battery to the starter motor if the detected voltage at the secondary battery is equal to or higher than the predetermined value whereas the starter relay is turned off to disallow a discharge from the secondary battery to the starter motor if the detected voltage is lower than the predetermined value, and the engine start procedure is repeated until the engine is started.

The vehicle engine starting system that drives a starter motor to start an engine by using a secondary battery as a power source comprises a voltage sensor that detects a voltage at the secondary battery and a control device that implements control so as to allow power from the secondary battery to be discharged to the starter motor if the voltage at the secondary battery detected by the voltage sensor is equal to or higher than a predetermined value and disallow a discharge from the secondary battery to the starter motor if the voltage at the secondary battery detected by the voltage sensor is lower than the predetermined value.

DETAILED DESCRIPTION OF THE PREFERRED EMBODIMENTS (First Embodiment)

Figure 1:
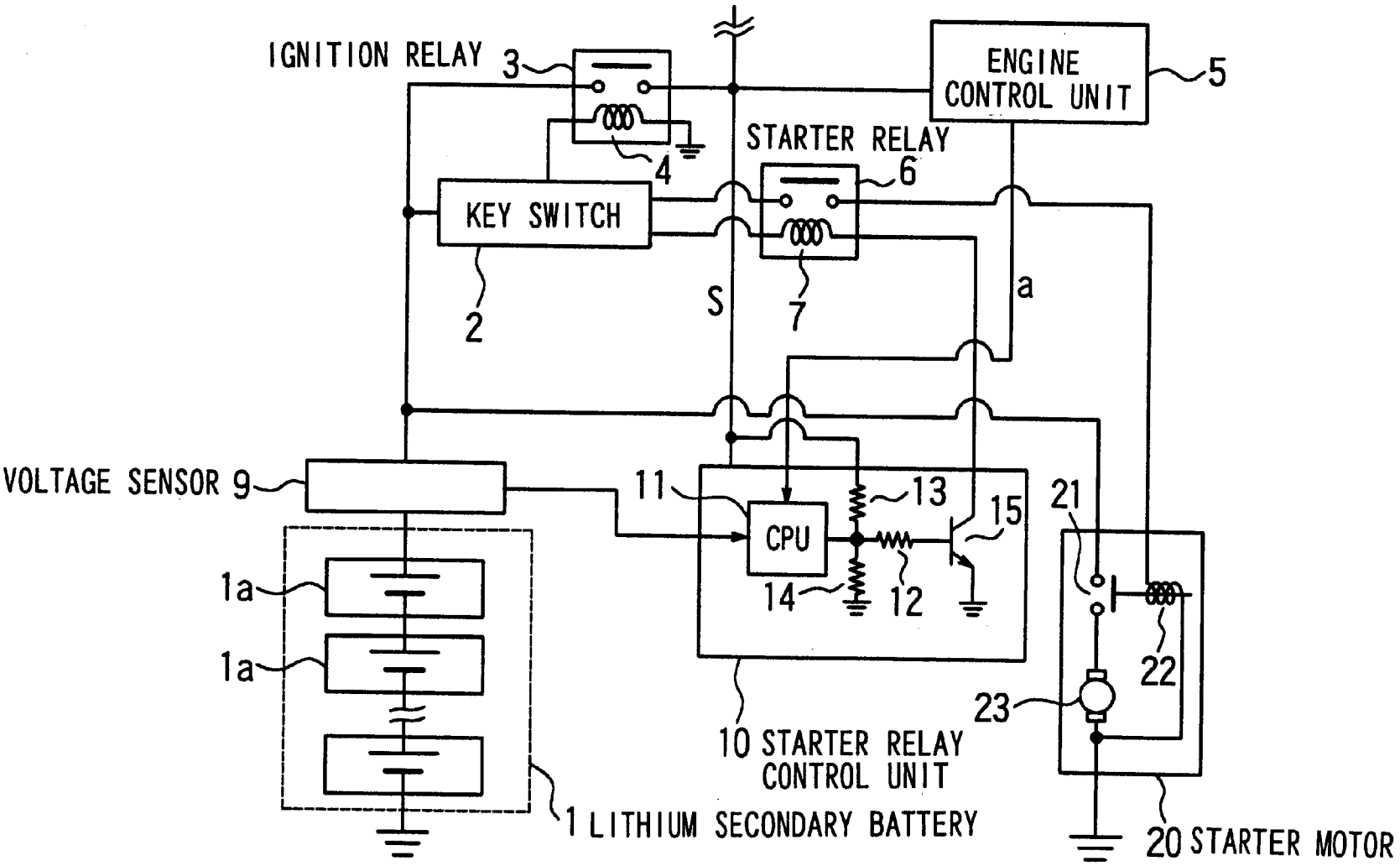
FIG. 1 is a block diagram of the structure assumed in a first embodiment of the vehicle engine starting system according to the present invention.

The following is an explanation of the first embodiment of the vehicle engine starting system according to the present invention. FIG. 1 is a block diagram showing the structure assumed in the vehicle engine starting system in the first embodiment.

A lithium secondary battery 1 is constituted of a battery pack achieved by connecting in series a plurality of lithium ion cells 1*a*. The lithium secondary battery 1 achieves characteristics whereby heat is generated internally during a discharge and the voltage level is quickly recovered once the discharge stops. The lithium secondary battery 1 is connected to an engine control unit 5 via an ignition relay 3 and also to a starter relay control unit 10. One end of a coil 4 of the ignition relay 3 is connected to the lithium secondary battery 1 via a key switch 2, and the other end of the coil 4 is grounded. When the key switch 2 is set to an ignition position (IGN), the ignition relay 3 is turned on and power is supplied to the engine control unit 5 and the starter relay control unit 10.

A starter motor 20 is connected with the lithium secondary battery 1 in parallel to the ignition relay 3. The starter motor 20 is constituted of a motor main body 23 and a motor switch 21 connected in series to the secondary battery 1. Drive power is directly supplied from the lithium secondary battery 1 to the motor main body 23 via the motor switch 21. One end of a coil 22 of the motor switch 21 is connected to the key switch 2 via a starter relay 6 and the other end of the coil 22 is grounded.

One end of a coil 7 of the starter relay 6 is connected to the key switch 2. The other end of the coil 7 is connected to the collector of a transistor 15 which is to be detailed later. Since the wiring connected to the starter motor 20 is divided into a discharge path from the secondary battery 1, i.e., a drive power line, and a control line, the starter relay 6 only needs to let a control signal for turning on/off the motor switch 21 pass through it. In other words, a low-load, inexpensive and compact starter relay 6 can be utilized.

The starter relay control unit 10 is provided with the transistor 15 which is controlled by a CPU 11. The base of the transistor 15 is connected to the CPU 11 via a resistor 12. A resistor 13 with one end thereof connected to a source line S on the downstream side of the ignition relay 3 and a resistor 14 with a grounded end are connected at the connecting point at which the resistor 12 and the CPU 11 are connected to each other. The collector of the transistor 15 is connected to the other end of the coil 7 of the starter relay 6, as mentioned earlier, and the emitter of the transistor 15 is grounded.

A bias voltage having been adjusted at the resistors 13 and 14 is applied as an H (high) level voltage to the base of the transistor 15 via the resistor 12 and an L (low) output from the CPU 11 switches the transistor 15 from an ON state to an OFF state. A complete ignition signal, which is to be detailed later, is input to the CPU 11 from the engine control unit 5.

The lithium secondary battery 1 is provided with a voltage sensor 9 that detects its terminal voltage. When the key switch 2 is set to the ignition position, the ignition relay 3 is turned on and power is supplied to the engine control unit 5 and the starter relay control unit 10. If the key switch 2 is turned to the start position, the starter relay control unit 10 implements ON/OFF control of the starter relay 6 in correspondence to the value of the terminal voltage at the lithium secondary battery 1. In addition, if the complete ignition signal is input from the engine control unit 5 to the starter relay control unit 10, the starter relay 6 is turned off and the engine start control ends.

Figure 2:
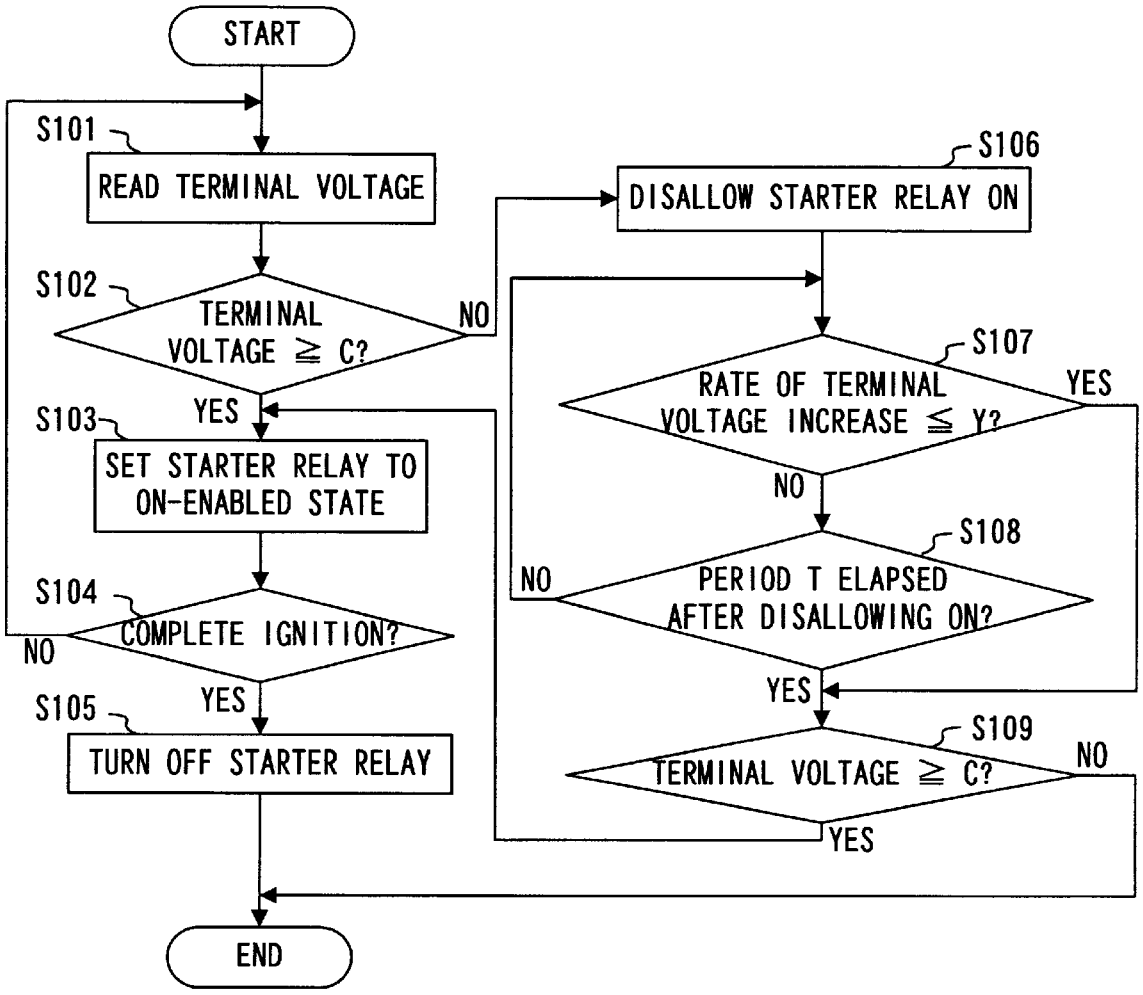
FIG. 2 is a flowchart of the start control procedure implemented in the first embodiment.

FIG. 2 presents a flowchart of the start control implemented by the CPU 11 of the starter relay control unit 10. The control procedure starts in step S101 as the key switch 2 is turned to the ignition position and power is supplied to the starter relay control unit 10.

In step S101, the terminal voltage at the secondary battery 1 is read from the voltage sensor 9. In the following step S102, it is judged as to whether or not the value of the voltage detected by the voltage sensor 9 is equal to or higher than a predetermined value C.

A value that is equal to or higher than the lower limit value of a voltage range over which the operation of the lithium secondary battery 1 is enabled and also matches the lowest voltage that allows the engine to be started should be selected for the predetermined value C. By selecting such a value for the predetermined value C, any internal shorting is prevented from occurring at the lithium secondary battery 1 due to a lowered voltage.

If it is decided in step S102 that the terminal voltage at the lithium secondary battery 1 is equal to or higher than the predetermined value C, the operation proceeds to step S103, whereas if it is decided that the terminal voltage is lower than the predetermined value C, the operation proceeds to step S106. In step S103, the transistor is sustained in an ON state by setting the base of the transistor 15 to H (high). As a result, the starter relay 6 enters an on-enabled state. It is to be noted that once the starter relay 6 enters the on-enabled state, the starter relay 6 can be turned on by turning the key switch 2 to the start position. When the starter relay 6 is set in the on-enabled state, the operation proceeds to step S104.

In step S104, it is judged as to whether or not a complete ignition signal "a" has been input from the engine control unit 5. While the starter motor 20 is utilized to start the engine, it is no longer necessary to engage the starter motor 20 once the engine is started. In other words, when the engine has been started and the drive force from the starter motor 20 is no longer required, the complete ignition signal "a" is output from the engine control unit 5.

As explained above, unless the key switch 2 is turned to the start position, the starter relay 6 is not turned on. Accordingly, as long as the key switch 2 is set at the ignition position, the processing in steps S101~S104 is repeated. If the key switch 2 is turned to the start position and the starter relay 6 is turned on while this processing is in progress, power is supplied to the coil 22. When power is supplied to the coil 22, the motor switch 21 is turned on and power is discharged (supplied) from the lithium secondary battery 1 to the starter motor (the motor main body 23). As a result, the starter motor 20 is driven to startup the engine.

If it is decided in step S104 that the complete ignition signal "a" has been input, i.e., if it is decided that the starter motor 20 has been driven and accordingly the engine has been started, the operation proceeds to step S105.

In step S105, the base of the transistor 15 is set to L (low) to turn off the transistor before the control procedure ends. Thus, it is ensured that the starter relay 6 is turned off even if the key switch 2 is still held at the start position and the operation of the starter motor 15 stops.

If it is decided in step S102 that the terminal voltage at the lithium secondary battery 1 is lower than the predetermined value C, the operation proceeds to step S106. In step S106, the base of the transistor 15 is set to L, thereby turning off the transistor to disallow the starter relay 6 from becoming turned on. Since this ensures that power is not discharged from the secondary battery 1 to the starter motor 20, the terminal voltage at the secondary battery 1 recovers quickly.

In the following step S107, it is judged as to whether or not the rate of increase (recovery) in the terminal voltage at the lithium secondary battery 1 is equal to or lower than a rate of increase Y (V/sec). The rate of increase of the terminal voltage varies depending upon the current terminal voltage at the lithium secondary battery 1. Namely, as the terminal voltage recovers and becomes higher, rate of increase of the terminal voltage decreases. If it is decided in step S107 that the rate of increase in the terminal voltage is not equal to or lower than Y, the operation proceeds to step S108, whereas if it is decided that it is equal to or lower than Y, the operation proceeds to step S109.

In step S108, it is judged as to whether or not a predetermined length of time T (sec) has elapsed since the transistor 15 was turned off in step S106. If it is decided that the predetermined length of time T has elapsed, the operation proceeds to step S109, whereas if it is decided that the predetermined length of time T has not elapsed yet, the operation returns to step S107.

It is to be noted that the speed at which the terminal voltage at the lithium secondary battery 1 recovers varies depending upon the rated capacity of the lithium secondary battery 1 and also, in particular, the temperature characteristics in the low temperature range. Accordingly, it is desirable to ascertain in advance the optimal values for the predetermined length of time T and the rate of a voltage increase Y through testing.

In step S109, it is judged again as to whether or not the terminal voltage at the lithium secondary battery 1 is equal to or higher than the predetermined value C. The terminal voltage at the secondary battery 1 is detected by the voltage sensor 9. If it is decided that the terminal voltage is equal to or higher than the predetermined value C, the operation proceeds to step S103. Since the processing implemented in step S103 and subsequent steps has been explained earlier, a repeated explanation is omitted. If, on the other hand, it is decided that the terminal voltage is lower than the predetermined value C, it is judged that the remaining capacity of the secondary battery 1 has been depleted and the control ends.

The engine start control described above achieves a state in which the starter motor 20 can be promptly driven to begin the engine startup as soon as the key switch is turned to the start position at a normal temperature, as long as there is available capacity in the lithium secondary battery 1, sufficient power output can be extracted from the lithium secondary battery 1 and the transistor 15 is in an ON state. When the engine startup is completed and the complete ignition signal "a" is output from the engine control unit 5, the transistor 15 is turned off, thereby immediately stopping the starter motor 20.

At a low temperature of, for instance, −30° C., the engine cannot be started readily. Accordingly, even if the terminal voltage at the lithium secondary battery 1 is determined to be equal to or higher than a predetermined value C (step S102) and the starter motor 20 is driven after the key switch 2 is set to the start position, the engine may not be started and the complete ignition signal "a" is not input (step S104 step S101). Thus, as the starter motor 20 is driven, lowering the terminal voltage to a level below the predetermined value C, the transistor 15 is turned off in step S106, thereby disallowing the discharge of power to the starter motor 20. The engine start control implemented at a low temperature is now explained in detail in reference to FIG. 3.

Figure 3:
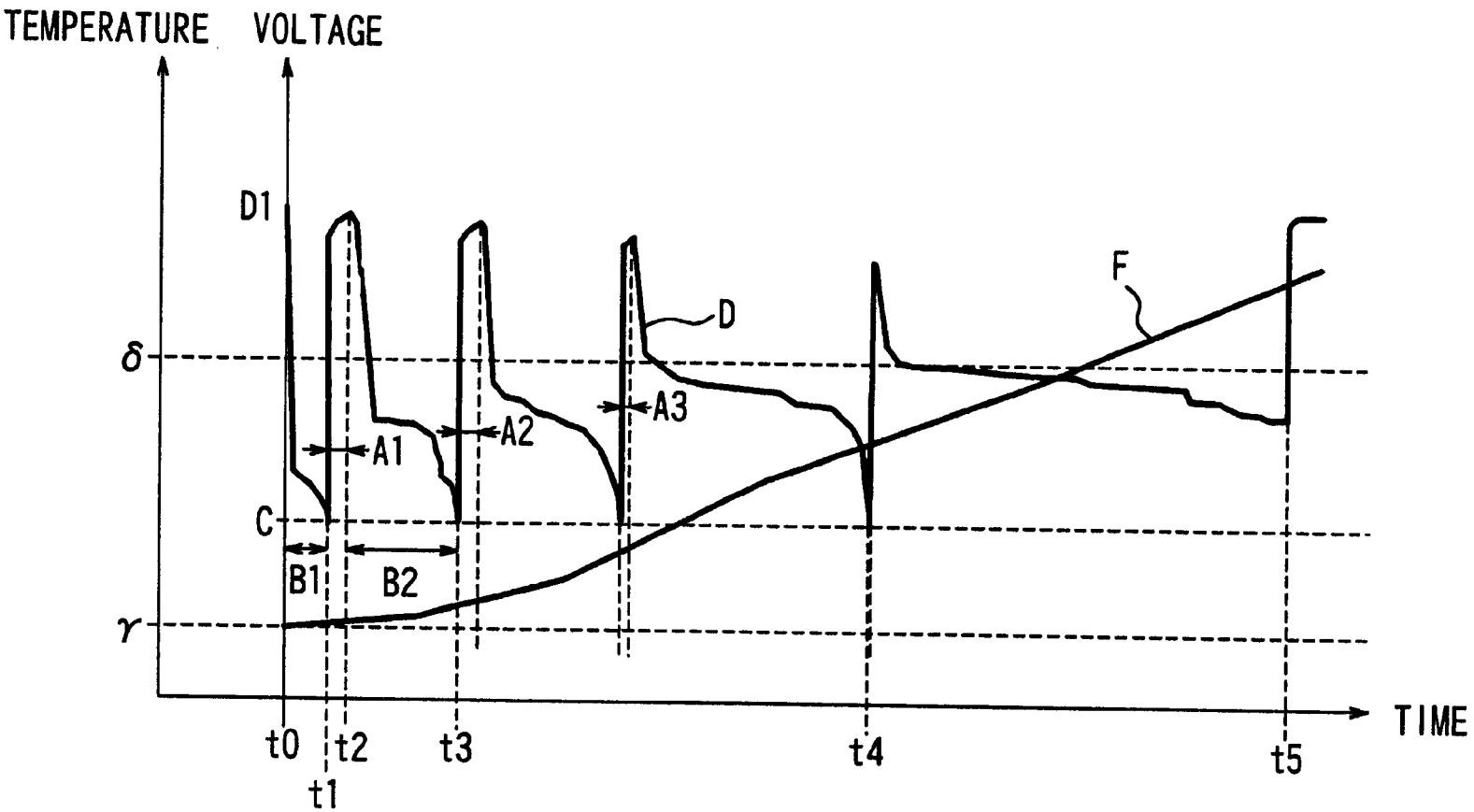
FIG. 3 shows changes in the terminal voltage D and the internal temperature at the secondary battery in the low temperature range.

FIG. 3 shows changes occurring over time in the terminal voltage D and the internal temperature F at the lithium secondary battery 1 at a low temperature. In the figure, γ indicates the internal temperature of the secondary battery 1 at the beginning of the engine start control and δ indicates the internal temperature of the battery at which the discharge characteristics enabling an engine startup by the starter motor 20 are achieved.

Since the internal temperature is low (F=γ), the terminal voltage D at the lithium secondary battery 1 is lowered to the predetermined value C from its initial voltage D1 after an extremely short period of time B1 following the start (at a time point t0) of the discharge to the starter motor 20. Consequently, the discharge from the lithium secondary battery 1 is stopped at a time point t1 at which the terminal voltage D is lowered to the predetermined value C.

After the discharge from the lithium secondary battery 1 is stopped, the terminal voltage level recovers quickly as the time elapses, as shown in FIG. 3. Subsequently, when the rate of terminal voltage increase is determined to be equal to or lower than Y (step S107) or when it is decided that the predetermined length of time T has elapsed after the transistor 15 was turned off (at the time point t1) (step S108), the terminal voltage D can be assumed to be equal to or higher than the predetermined value C. When the terminal voltage D is actually judged to be equal to or higher than the predetermined value C, the transistor 15 enters an on-enabled state (at a time point t2). If the key switch 2 is held at the start position at this time, a discharge of power from the lithium secondary battery 1 is started to drive the starter motor 20. It is to be noted that if the key switch 2 has been reset to the ignition position, a discharge of power to the starter motor 20 is started by turning the key switch 2 to the start position.

During this period, the internal temperature F at the lithium secondary battery 1 rises slightly due to the heat generated inside the battery by the discharge current which flows before the discharge is stopped.

If the engine cannot be started even by restarting the discharge to the starter motor 20, the terminal voltage becomes lowered to the predetermined value C over a time period B2. As a result, the discharge is stopped at a time point t3 at which the terminal voltage D is lowered to the predetermined value C. Since the internal temperature F at the lithium secondary battery 1 has risen, the discharge characteristics have been improved. For this reason, the period of time B2 over which the discharge continues is longer than the period of time B1 over which power was discharged previously.

While the starter motor 20 is driven by supplying/cutting off power to the starter motor 20, the recovery time of the discharge characteristics of the lithium secondary battery 1 improve as the internal temperature F rises. As a result, the period of time A (A1, A2, . . . ) to elapse after the discharge is stopped until the discharge is restarted is gradually shortened.

After a discharge is started at a time point t4, the discharge characteristics enabling an engine startup by the starter motor 20 are achieved once the internal temperature F rises to a level exceeding δ. As a result, the engine is started at the next discharge start time point t5. When the complete ignition signal "a" is output from the engine control unit 5 at the time point t5, the transistor 15 is turned off and the starter motor 20 is stopped, thereby ending the control.

A vehicle engine starting system in the first embodiment which turns on/off the starter motor 20 in conformance to the level of the terminal voltage by taking advantage of the recovery characteristics of the lithium secondary battery 1 does not require a heater that heats the battery 1 from the outside or a temperature sensor that detects the temperature in the vicinity of the battery 1. In addition, it does not need to implement complex processing for engaging the heater in operation based upon the terminal voltage at the lithium secondary battery 1 and the temperature in the vicinity of the battery 1 and then controlling the starter relay in correspondence to the terminal voltage. Consequently, the system structure is simplified, a reduction in production costs is achieved and the reliability is improved.

Even when the engine is started at a low temperature, the discharge current from the lithium secondary battery 1 is primarily utilized to drive the starter motor 20 and is not used to continuously engage the heater in operation. In addition, by turning on/off the starter motor 20 in conformance to the level of the terminal voltage, any internal shorting at the lithium secondary battery 1 is prevented to ensure that the service life of the secondary battery 1 is not reduced.

Since the discharge to the starter motor 20 is stopped even if the key switch 2 is held at the start position after the engine startup is completed, wasteful power consumption is minimized. Since this also prevents the starter motor 20 from continuing to rotate after the engine startup is completed, the service life of the starter motor 20 is lengthened as well. Also, since the control described above eliminates the need for a large starter motor 20 to start the engine, miniaturization and a weight reduction can be achieved for the starter motor 20.

(Second Embodiment)

Figure 4:
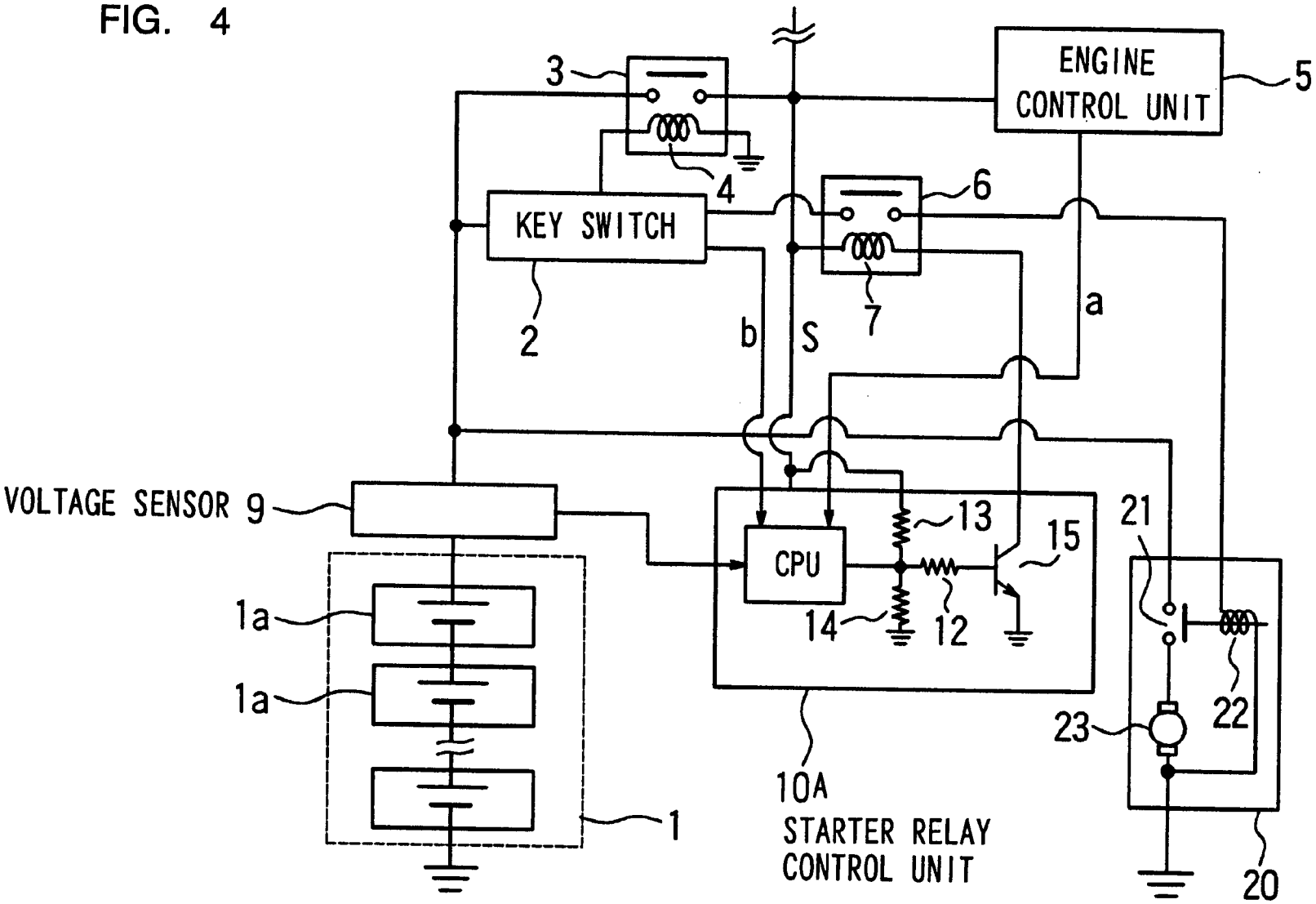
FIG. 4 is a block diagram of the structure assumed in a second embodiment of the vehicle engine starting system according to the present invention.

FIG. 4 is a block diagram of the structure adopted in the vehicle engine starting system in the second embodiment. The vehicle engine starting system in the second embodiment differs from the vehicle engine starting system in the first embodiment in the power source from which power is supplied to the starter relay 6. The following explanation focuses on the difference from the vehicle engine starting system in the first embodiment and a repeated explanation of identical features is omitted.

One end of the coil 7 of the starter relay 6 is connected to the source line S on the downstream side of the ignition relay 3, and the other end of the coil 7 is connected to the collector of the transistor 15. The key switch 2 is connected to a starter relay control unit 10A. The start signal "b" indicating that the key switch 2 is at the start position is input from the key switch 2 to the CPU 11 of the starter relay control unit 10A.

Figure 5:
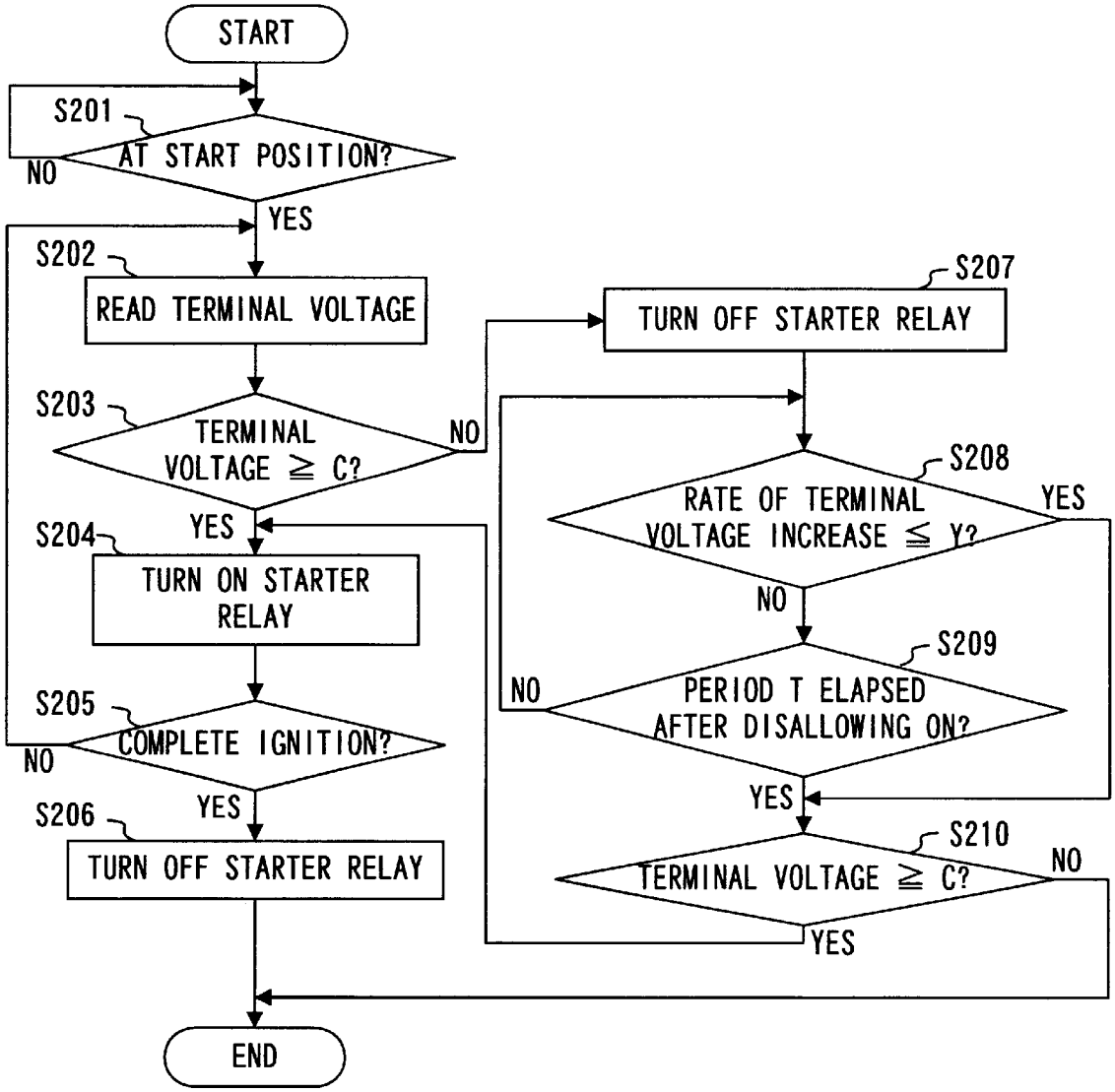
FIG. 5 is a flowchart of the start control procedure implemented in the second embodiment.
Figure 6:
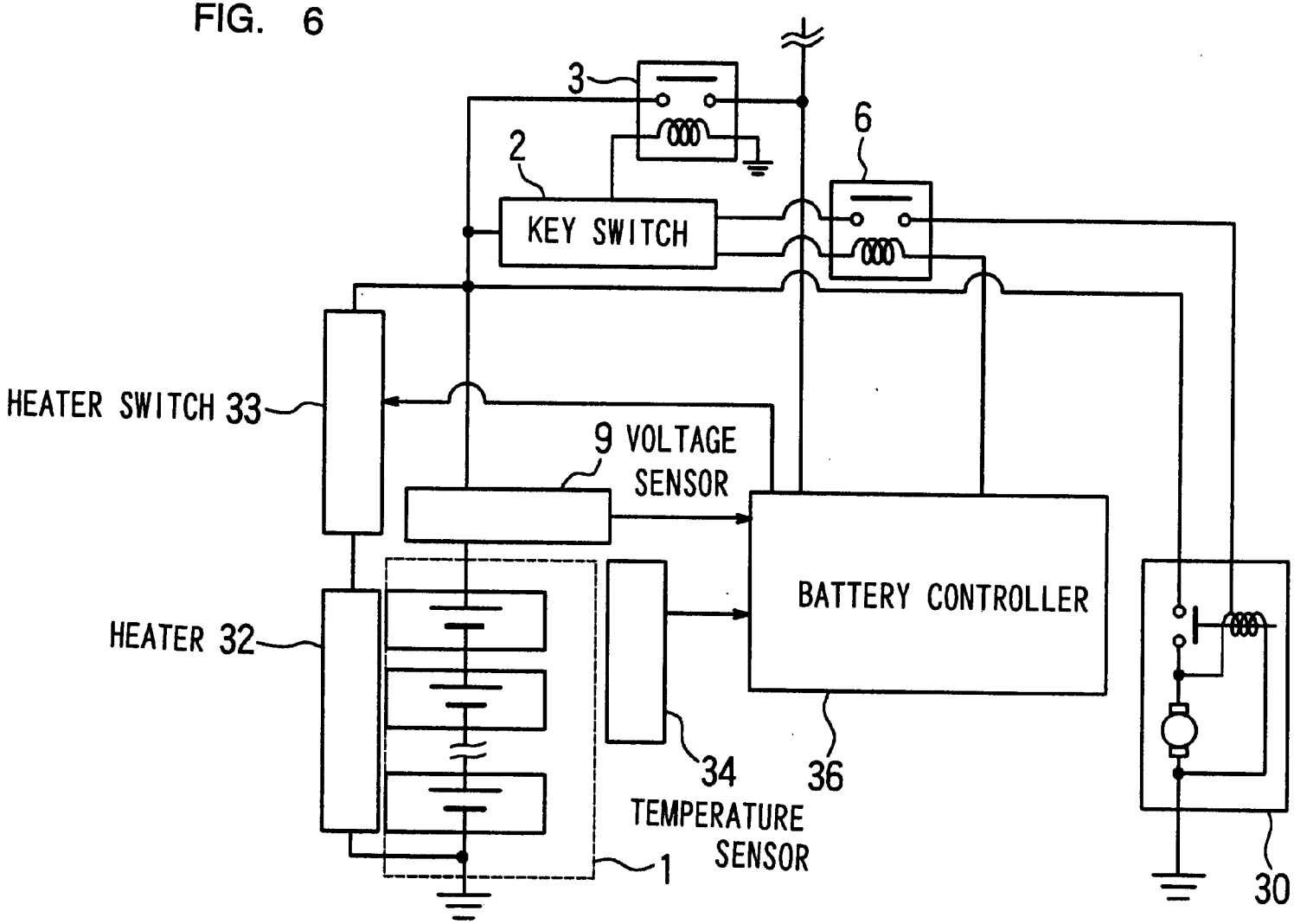
FIG. 6 shows the structure of a vehicle engine starting system adopting the prior art.
Figure 7:
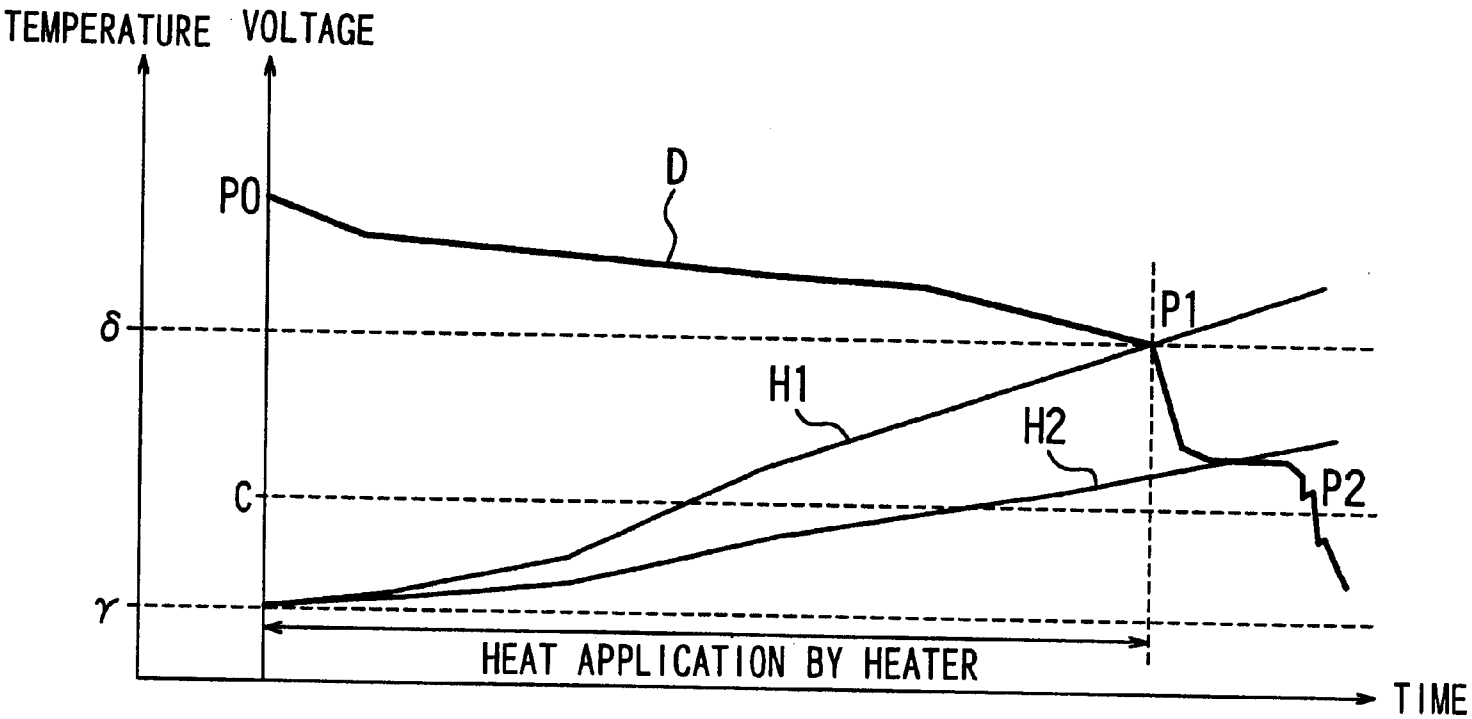
FIG. 7 shows the change taking place over time with regard to the relationship among the terminal voltage D, the surface temperature H1 and the internal temperature H2 of the secondary battery in the low temperature range and is provided to facilitate an explanation of the problems of the prior art.

FIG. 5 presents a flowchart of the start control procedure implemented in the vehicle engine starting system in the second embodiment. The control is started as the key switch 2 is determined to be at the ignition position and power is supplied to the starter relay control unit 10A. This control is implemented by the CPU 11 of the starter relay control unit 1A. The following explanation focuses on start control steps that are different from those implemented in the start control achieved in the vehicle engine starting system in the first embodiment.

In step S201, it is judged as to whether or not the start signal "b" has been input from the key switch 2. If it is decided that the key switch 2 has been turned to the start position and the start signal "b" has been input, the operation proceeds to step S202. If, on the other hand, it is decided that the start signal "b" has not been input, the operation remains in the standby state in step S201 until it is decided that the start signal "b" has been input.

Since the processing implemented in steps S202 and S203 is identical to the processing implemented in steps S101 and S102 in the flowchart shown in FIG. 2, its explanation is omitted.

If it is decided in step S203 that the terminal voltage is equal to or higher than the predetermined value C, the operation proceeds to step S204. In step S204, the starter relay 6 is turned on. Since the coil 7 of the starter relay 6 is connected to the source line S on the downstream side of the ignition relay 3, the starter relay 6 is turned on by setting the base of the transistor 15 to H and thus turning on the transistor. In response, power is discharged from the lithium secondary battery 1 to the starter motor 20, and the starter motor 20 is driven to begin an engine startup.

In the following step S205, it is judged as to whether or not the complete ignition signal "a" has been input from the engine control unit 5. If it is decided that the complete ignition signal "a" has been input, the operation proceeds to step S206. If, on the other hand, it is decided that the complete ignition signal "a" has not been input yet, the operation returns to step S202 to repeat the processing from step S202 through step S205.

In step S206, by which the engine will have been started, the starter relay 6 is turned off before ending the control. Namely, the base of the transistor 15 is set to L to turn off the transistor. As a result, the starter relay 6 is turned off regardless of the position at which the key switch 2 is currently set, thereby stopping the operation of the starter motor 20.

If, however, it is decided in step S203 that the terminal voltage at the lithium secondary battery 1 is lower than the predetermined value C, the operation proceeds to step S207. Since the processing implemented in steps S207~S210 is identical to the processing implemented in steps S106~S109 in the flowchart presented in FIG. 2, its explanation is omitted.

The vehicle engine starting system in the second embodiment achieves the following advantages in addition to advantages similar to those realized in the vehicle engine starting system in the first embodiment. Since the coil 7 of the starter relay 6 is directly connected to the source line S without the key switch 2 present between them, the start control is automatically sustained regardless of how the key switch 2 is operated once the start signal "b" from the key switch 2 is input and the starter relay 6 is turned on based upon the terminal voltage. In other words, an advantage is achieved in that since the drive control of the starter motor 20 is implemented based upon the terminal voltage until the complete ignition signal "a" is input, the start control is sustained automatically until the engine startup is completed even if the key switch 2 is first turned to the start position and then is reset to the ignition position. Consequently, even when the engine cannot be started readily at a low temperature, the driver only needs to turn the key switch 2 to the start position once to start the engine.

It is even more desirable to provide an indicator to indicate that the engine start control is in progress when the key switch 2 is reset from the start position.

The present invention is not limited to the embodiments described above. For instance, while an explanation is given in reference to embodiments on an example in which the lithium secondary battery 1 is utilized as the drive source for the starter motor 20. However, the vehicle engine starting system according to the present invention may be adopted in a similar manner in conjunction with any secondary battery as long as it achieves characteristics whereby heat is generated internally during a discharge and prompt voltage recovery characteristics whereby the voltage level is recovered promptly after the discharge is stopped.

In addition, while the starter motor 20 is constituted of the motor main body 23 and the motor switch 21 in the embodiments explained above, the present invention is not limited to these structural particulars. For instance, the starter relay 6 may be connected to the source line S instead of the key switch 2 and the drive power to the motor main body 23 may be directly turned on/off by the starter relay 6 without providing the motor switch 21.

The disclosure of the following priority application is herein incorporated by reference: Japanese Patent Application No. 2000-392152 filed Dec. 25, 2000

What is claimed is:

1. A vehicle engine starting method for driving a starter motor by using a battery as a power source, comprising:

detecting a voltage at said battery;

comparing the detected voltage at said battery with a predetermined value; and allowing a discharge from said battery to said starter motor if the detected voltage at said battery is equal to or higher than the predetermined value, and disallowing a discharge from said battery to said starter motor if the detected voltage is lower than the predetermined value.

2. A vehicle engine starting method for supplying power in a battery to a starter motor engaged to start an engine via a key switch and a starter relay, comprising an engine start procedure including:

detecting a voltage at said battery;

comparing the detected voltage at said battery with a predetermined value;

setting said starter relay in an on-enabled state if the detected voltage at said battery is equal to or higher than the predetermined value and setting said starter relay in an on-disabled state if the detected voltage is lower than the predetermined value; and turning on said starter relay to discharge power from said battery to said starter motor as said key switch is set to a start position while said starter relay is in the on-enabled state, wherein:

said engine start procedure is repeated until the engine is started.

3. A vehicle engine starting method for supplying power in a battery to a starter motor engaged to start an engine via a key switch and a starter relay, comprising an engine start procedure including:

detecting as to whether or not said key switch is at a start position;

detecting a voltage at said battery once said key switch is set to the start position;

comparing the detected voltage at said battery with a predetermined value; and turning on said starter relay to discharge power from said battery to said starter motor if the detected voltage at said battery is equal to or higher than the predetermined value, and turning off said starter relay to disallow a discharge from said battery to said starter motor if the detected voltage is lower than the predetermined value, wherein:

said engine start procedure is repeated until the engine is started.

4. A vehicle engine starting system for driving a starter motor engaged to start an engine by using a battery as a power source, comprising:

a voltage sensor that detects a voltage at said battery; and a control device that allows power to be discharged from said battery to said starter motor if the voltage at said battery detected by said voltage sensor is equal to or higher than a predetermined value and disallows a discharge from said battery to said starter motor if the voltage at said battery detected by said voltage sensor is lower than the predetermined value.

5. A vehicle engine starting system according to claim 4, further comprising:

a starter relay provided between a key switch and said starter motor, wherein:

said control device implements control to allow/disallow a discharge from said battery to said starter motor by turning on/off said starter relay.

6. A vehicle engine starting system according to claim 5, wherein:

said starter relay enters an on-enabled state when said key switch is set to a start position and power is supplied from said battery.

7. A vehicle engine starting system according to claim 5, wherein:

power is directly supplied to said starter relay without passing through said key switch; and said control device turns on/off said starter relay after receiving a signal indicating that said key switch is set at a start position.

8. A vehicle engine starting system according to claim 7, wherein:

said control device repeatedly turns on/off said starter relay until the engine is started after receiving the signal indicating that said key switch is set at the start position.

9. A vehicle engine starting system according to claim 5, wherein:

said starter motor is provided with a motor switch in a discharge path through which power is discharged from said battery; and said starter relay turns on/off said motor switch to implement control to allow/disallow a discharge from said battery to said starter motor.

10. A vehicle engine starting system for driving a starter motor engaged to start an engine by using a battery as a power source, comprising:

a voltage detection means for detecting a voltage at said battery; and a control means for allowing power to be discharged from said battery to said starter motor if the voltage at said battery detected by said voltage detection means is equal to or higher than a predetermined value and disallowing a discharge from said battery to said starter motor if the voltage at said battery detected by said voltage detection means is lower than the predetermined value.

* * * * *